United States Patent [19]

Seff

[11] 4,006,604

[45] Feb. 8, 1977

[54] AIR CONDITIONED PILLOW

[75] Inventor: David Seff, New York, N.Y.

[73] Assignee: Lawrence Peska Associates, Inc., New York, N.Y. ; a part interest

[22] Filed: Jan. 23, 1976

[21] Appl. No.: 651,649

[52] U.S. Cl. ..... 62/261; 5/284; 5/347; 165/46

[51] Int. Cl.[2] ..... F25D 23/12

[58] Field of Search ..... 62/261; 5/284, 347; 98/89

[56] References Cited

UNITED STATES PATENTS

| | | | |
|---|---|---|---|
| 1,896,953 | 2/1933 | Hassell | 62/261 |
| 2,461,432 | 2/1949 | Mitchell | 62/261 |
| 2,493,067 | 1/1950 | Goldsmith | 62/261 |
| 2,566,865 | 9/1951 | Wingerter | 62/261 |
| 2,782,834 | 2/1957 | Vigo | 62/261 |
| 2,913,833 | 11/1959 | Glintz | 5/284 |
| 3,101,488 | 8/1963 | Peebles | 5/347 |

*Primary Examiner*—Lloyd L. King

[57] ABSTRACT

A pillow includes an inner hollow chamber having an inlet for cool air at one end connected to a portable air conditioning unit. The chamber has thin flexible permeable walls permitting air to pass into a first surrounding layer of soft material. A non-porous air-tight lining directs the air toward one end of the first layer and around the lining through a soft outer layer toward an outlet at the opposite end. The layered construction provides uniform air distribution. Warm air from the outlet is directed both through a flexible hose to the air conditioner where it is cooled and recycled through the pillow. A detachable control unit is located adjacent to the pillow or bed. The cool pillow provides added comfort for restful sleep during hot humid weather conditions.

8 Claims, 2 Drawing Figures

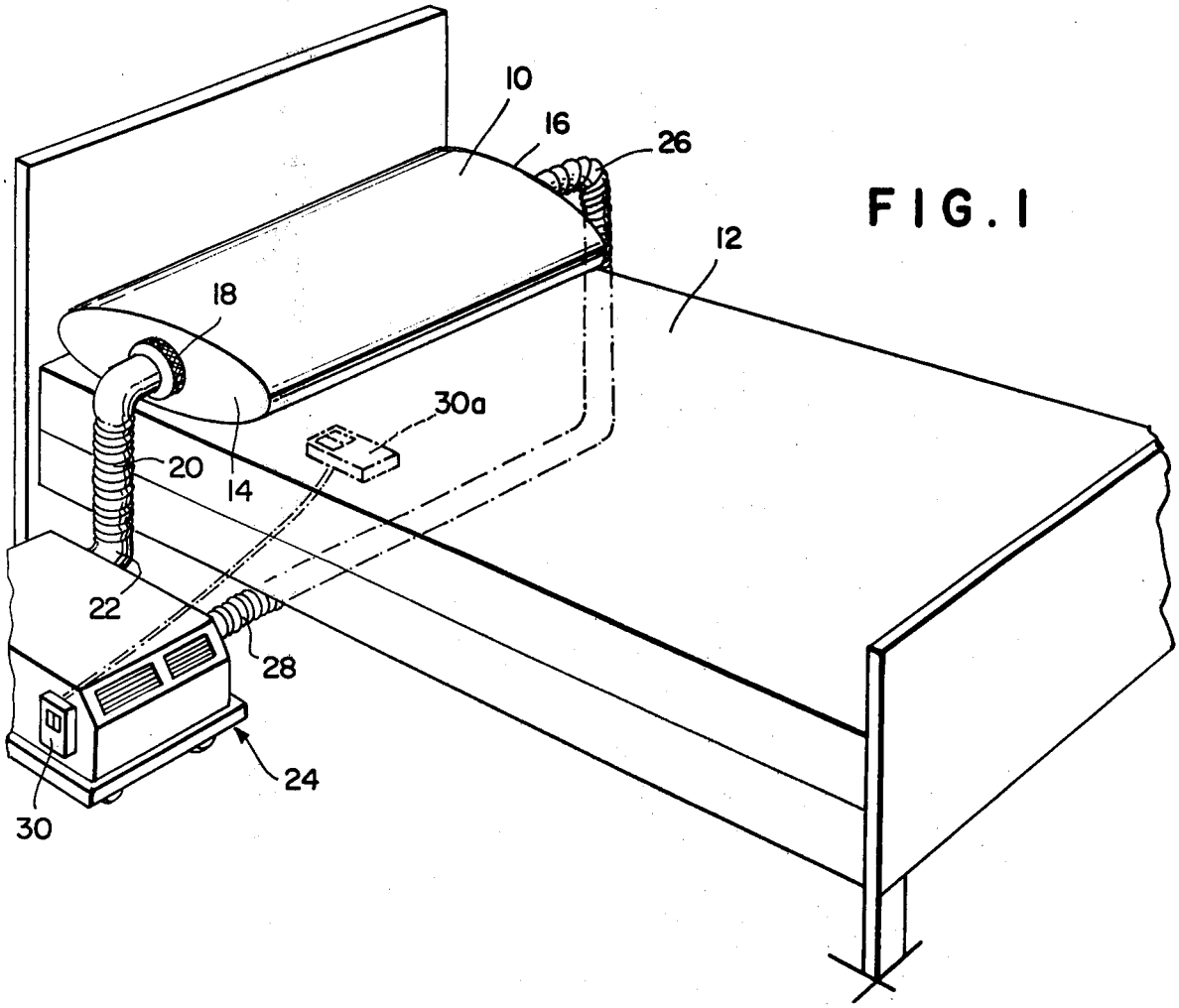
FIG. 1
FIG. 2
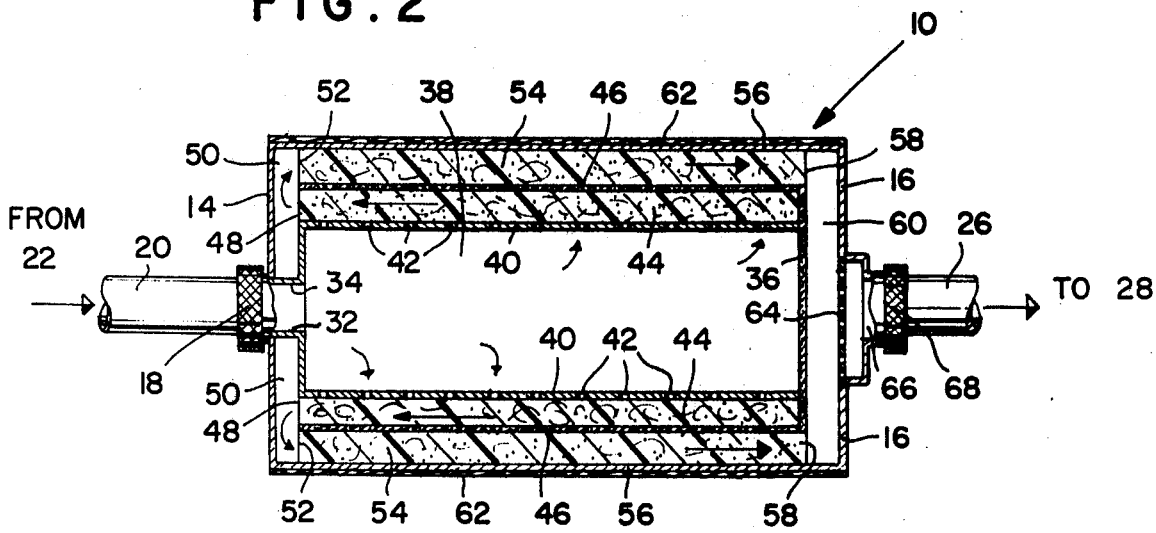

AIR CONDITIONED PILLOW

BACKGROUND OF THE INVENTION

1. Field of the Invention

The invention relates to an air conditioned pillow or cushion and particularly to a pillow construction for directing cool air therethrough.

2. Description of the Prior Art

Presently available devices for providing cool air to persons lying in bed generally require large enclosures around the entire bed which direct air onto all body areas. Such devices are shown in U.S. Pat. No. 2,288,538, issued June 30, 1942 and U.S. Pat. No. 2,154,638, issued Apr. 18, 1939. Other devices have been used for ventilating cushions such as used on automobile seats, as shown in U.S. Pat. No. 3,370,520, issued Feb. 27, 1968. None of these, however, provides a device for circulating cool air through layers of soft material within a pillow.

SUMMARY OF THE INVENTION

It is therefore the primary object of the present invention to provide an air conditioned pillow having a particular layered structure which directs and distributes cool air in a uniform manner within the pillow.

This is achieved with a pillow having an inner hollow flexible chamber with thin permeable walls. Cool air from a portable air conditioning unit is connected to one side of the chamber and passes through the walls into a first surrounding layer of soft material. A non-porous airtight lining directs the air out of one end of the layer into a second outer layer toward an outlet at the other end. The warm air is then returned through a hose to the air conditioner for further cooling. A separate control unit is provided for convenient access. Other objects and advantages will become apparent from the following description in conjunction with the accompanying drawings.

BRIEF DESCRIPTION OF THE DRAWINGS

FIG. 1 is a pictorial representation of the air conditioning system connected to the pillow on a bed, and FIG. 2 is a cross-section of the pillow showing the layered structure and air passages.

DESCRIPTION OF THE PREFERRED EMBODIMENT

As shown in FIG. 1, a pillow 10 rests at the head of a bed 12. The pillow has opposite end walls 14, 16 of an elongated curved shape formed of a pliant non-porous fabric such as a suitable plastic. One end wall 14 has a coupling 18 to a flexible hose 20 which is connected to the cool air outlet 22 of a portable air conditioning unit 24. The other end 16 is connected through another coupling and hose 26 to return warm air to the inlet 28 of the air conditioner. A detachable control unit 30, which regulates the air conditioner, is connected by a long cable so that it may be placed in any convenient location **30*a***, to permit selective control by the person using the pillow.

As shown in FIG. 2, the cool air from hose 20 passes through coupling 18 to an inlet 32 through end wall 14 and an opening in an inner wall 34 of pliant non-porous airtight material. Wall 34 and another like wall 36 at the opposite side form the ends of an inner hollow air chamber 38. Extending between the ends of the chamber is a curved inner longitudinal wall 40 of a porous flexible material which surrounds the remaining portions of the chamber. Wall 40 contains a plurality of small holes 42 which permit passage of cold air out of the chamber into a surrounding layer 44 of a soft pillow material such as foam rubber or feathers.

An intermediate curved flexible lining 46 of a non-porous airtight material surrounds layer 44 and forms an air passageway through layer 44. The non-porous end wall 36 extends across the right end of layer 44 and prevents the air from flowing out of that end. The cool air from chamber 38 and wall 40 is thus directed along layer 44 toward an opening 48 around the left end of the layer. The arrangement of holes in wall 40 provides an even distribution of air through layer 44.

The air then flows out of opening 48 into a side passageway 50 at the left end and around through opening 52 into an outer layer 54 of soft pillow material surrounding layer 44 and lining 46. The outer lining of material 56 is also preferably non-porous so that air is directed along layer 54 toward another opening 58 into side passageway 60 at the right end. An outer cover 62 of a soft smooth porous fabric may enclose the outer lining 56.

The air then passes through a permeable wall section 64 in end wall 16 and an outlet 66 connected to flexible hose 26 by coupling 68. The warmer air is then returned through hose 26 to inlet 28 of the air conditioner for cooling and recycling. The layered structure and passageways through the pillow may be varied to suit different inlet and outlet configurations, such as where the inlet and outlets are on the same side or at the back of the pillow. The small portable air conditioner is relatively quiet and the closed system and use of sound absorbing materials in the pillow provide a minimum of noise. While only a single embodiment has been illustrated and fully described, it is apparent that many variations may be made in the particular design and configuration without departing from the scope of the invention as set forth in the appended claims.

What is claimed is:

1. A cooling device comprising:

a. an enclosure having thin flexible airtight walls;

b. an air inlet in a wall at one section of said enclosure;

c. an air outlet in a wall at another section of said enclosure;

d. an inner air chamber within said enclosure having flexible airtight end walls and flexible porous walls surrounding other portions of said chamber, said inlet extending through one said end wall;

e. a layer of soft pliant material surrounding said porous walls of said chamber, and f. means for directing air from said porous walls through said layer to said outlet.

2. The device of claim 1 wherein said means for directing air includes an airtight lining around said layer, said lining having an opening at one end of said layer providing a passageway for air through said layer, and a second layer of soft pliant material between said lining and said enclosure walls, said second layer being open to air at the opposite ends, said second layer providing a second air passageway between said first layer and said outlet.

3. The device of claim 2 wherein said enclosure includes flexible airtight outer end walls spaced from said end walls of said chamber, the space between said walls at one end providing an air passageway between said first and second layers, and the space between said walls at the other end providing an air passageway between said second layer and said outlet.

4. The device of claim 3 wherein one outer end wall includes said air outlet.

5. The device of claim 4 wherein said other outer end wall includes a permeable wall section between said outlet and said air passageway at said other end.

6. The device of claim 5 including an air conditioning unit providing cool air, a flexible hose connecting said cool air to said air inlet, and a second flexible hose returning air from said outlet to said air conditioning unit.

7. The device of claim 6 wherein said air conditioning unit has a detachable control unit positionable at a location spaced from said air conditioning unit.

8. The device of claim 3 wherein said enclosure is in the form of a pillow and includes an outer fabric cover.

* * * * *